US005890884A

United States Patent [19]

Zimmern

[11] Patent Number: 5,890,884

[45] Date of Patent: Apr. 6, 1999

[54] SCREW-TYPE COMPRESSOR WITH LIQUID LOCK PROTECTION

[76] Inventor: Bernard Zimmern, 6, New St., East Norwalk, Conn. 06855

[21] Appl. No.: 945,085

[22] PCT Filed: Apr. 19, 1996

[86] PCT No.: PCT/FR96/00603

§ 371 Date: Oct. 16, 1997

§ 102(e) Date: Oct. 16, 1997

[87] PCT Pub. No.: WO96/34204

PCT Pub. Date: Oct. 31, 1996

[30] Foreign Application Priority Data

Apr. 28, 1995 [FR] France ..... 95 05108

[51] Int. Cl.[6] ..... F04C 18/52

[52] U.S. Cl. ..... 418/152; 418/195

[58] Field of Search ..... 418/107, 152, 418/195

[56] References Cited

FOREIGN PATENT DOCUMENTS

| | | | |
|---|---|---|---|
| 1496275 | 12/1967 | France . | |
| 1586832 | 3/1970 | France . | |
| 2148677 | 3/1973 | France . | |
| 2267462 | 11/1975 | France . | |
| 2624215 | 6/1989 | France | 418/195 |

*Primary Examiner*—John J. Vrablik
*Attorney, Agent, or Firm*—Young & Thompson

[57] ABSTRACT

A rotary compressor of the type provided with a screw (1) and pinion gear (4) is protected from liquid lock effects by disc spring (17) which applies on the pinion gear shaft (11) a pressure higher than the maximum thrust applied on the pinion gear during normal compressor operation.

7 Claims, 2 Drawing Sheets

SCREW-TYPE COMPRESSOR WITH LIQUID LOCK PROTECTION

This invention relates to a positive displacement rotary compressor of the screw and gaterotor type.

It is known for instance from French Patent No. 1,331,998 (U.S. Pat. No. 3,180,565) to build compressors comprising a screw with grooves rotating in a bore of a casing and cooperating with at least one gaterotor having teeth meshingly protruding in said grooves to define with the casing variable volume chambers.

It is also known by U.S. Pat. No. 5,080,568 to mount gaterotors rotating around a shaft set inside the gaterotor and to locate the gaterotor shaft axially by securing the shaft to the casing on the side of the gaterotor exposed to the pressure.

This invention relates to a compressor to compress a gas between a low and a high pressure, comprising a screw provided with at least one groove, rotatably mounted in a casing and cooperating with at least one gaterotor carrying teeth which meshingly protrude into the groove to define with the casing a volume for increase of pressure of the fluid, one side of the teeth being exposed to the high pressure fluid, whereas the other side is exposed to the low pressure fluid, this gaterotor comprising a plastic sheet carrying the teeth in sealing engagement with the groove and located on the high pressure side of the gaterotor, supported by a metal support on the low pressure side, the high pressure side of the plastic sheet being in sealing proximity of a lip of the casing, thrust means to create a load pressing the gaterotor shaft against stopping means, the thrust load created by said means being higher than the maximum load carried by the gaterotor during normal operation of the compressor.

This construction has the remarkable effect to substantially reduce the damages created to the compressor by what is commonly called a liquid lock without a deterioration of the plastic teeth profile or of the compressor performances.

It is indeed known in the refrigeration and air conditioning industry that under certain conditions, particularly at start-up, the compressor may happen for a very short period, generally less than a second, to have to compress liquid instead of gas and this creates what is generally called a liquid lock.

Indeed, as the volume of the groove reduces to insure gas compression and as liquid is not compressible, when gas is replaced by liquid, enormous pressures are generated in the groove until something breaks or clearances are created through which the liquid can escape. The pressures created are many times the maximum pressures for which the compressor is designed, commonly 10 or 20 times higher.

According to the invention if such liquid lock happens, the pressure in the groove will generate an axial thrust on the gaterotor largely exceeding the thrust load generated by the thrust means and the gaterotor will move axially, thereby opening a gap between the high pressure side of the teeth and the lip of the casing, allowing the excess liquid in the groove to escape through this gap and thereby allowing to maintain the pressure in the groove within acceptable limits.

Nevertheless, when such axial displacement of the gaterotor happens, the flanks of the teeth of the gaterotors are no longer at their proper operating position. It is known that such displacement has the same effect as if the width of the groove was suddenly narrowed. The larger the displacement, the more the teeth have to distort so as to accommodate what looks like narrower grooves. If the gaterotor teeth were completely in metal, something would break, either the teeth or the threads, or be severely damaged; plastic is more flexible and does not break but should it stay for some time at the new position created by the displacement, it would wear so that the teeth adjust their shape to the seemingly narrower groove; when moved back to the original position, this wear would translate into increased leakage losses and substantially diminished efficiency performances.

For instance, in air-conditioning compressors delivering around 100 tons of refrigeration, with a drop of gaterotor of around 0.5 millimeters, permanent losses of capacity in the order of magnitude of 5% can be measured after operating for a few hours.

The remarkable result which has been found is that, even though the compressor is submitted to repeated liquid locks, no drop of performance is observed.

It is likely that because of the short length of time during which high pressures in the groove occur and displace the gaterotor out of its normal position, because the plastic is relatively flexible and has good wear resistance property, no measurable wear is really inflicted to the gaterotor.

This invention will be better understood by reading the following description given as a non-limiting example by reference to the accompanying drawings in which.

Figure 1:
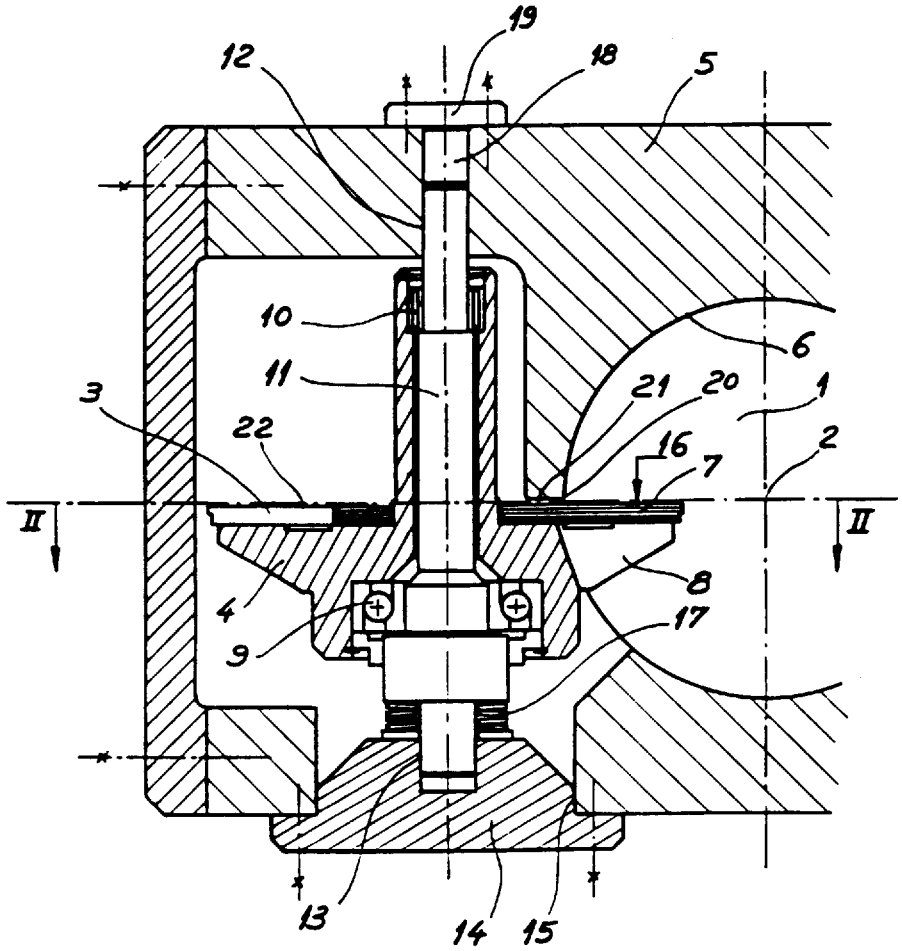
FIG. 1 is a sectional part view, along line I—I of FIG. 2 of a preferred embodiment of a machine according to the invention, along the axis of a gaterotor thereof perpendicular to the screw axis.

The machine shown in FIG. 1 is a modification according to the invention of a machine such as shown in French Patent No. 1,331,998.

Figure 2:
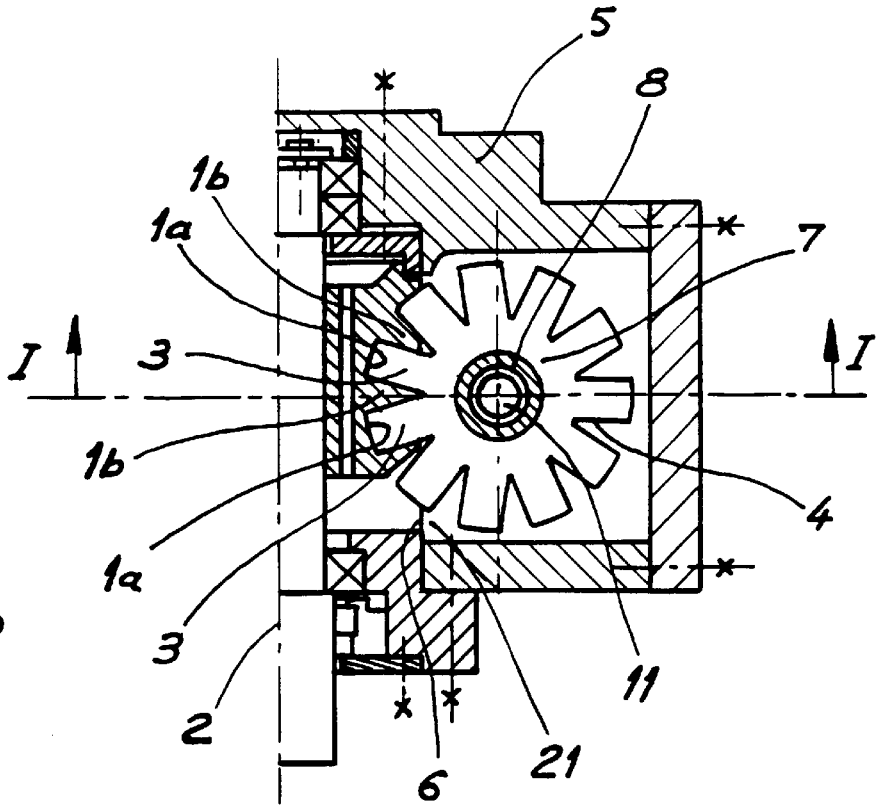
FIG. 2 is a diagrammatic sectional half-view of the machine along line II—II of FIG. 1.

A screw 1 rotatable around an axis 2 is provided with generally helical groove 1*a* (FIG. 2) which meshes with teeth such as 3 of gaterotor 4. Both are mounted in a casing S having a bore 6 of which proximity with the top of screw threads 1*b* separating the screw grooves 1*a* from each other provides nearly complete sealing. Due to meshing between the screw 1 and the gaterotor 4, rotation of the screw 1 entails corresponding rotation of the gaterotor.

The gaterotor is made in a known way of a plastic sheet 7 supported by a metal support 8, such metal support carrying itself two bearings 9 and 10 rotatably supporting the gaterotor 4 onto a shaft 11.

The shaft 11 has its axis set by a bore 12 in the casing and a bore 13 in a holder 14 which is itself centered in a bore 15 of the casing.

In such a structure the fluid to be compressed has its high pressure acting according to the direction of arrow 16 thereby pushing the gaterotor to rest on bearing 9.

According to the invention, thrust means such as the disc springs 17 are pushing the shaft 11 against a stop 18 which is itself held in position by a cover 19 attached to the casing.

The length of the stop 18 is set such that after assembly, the gap 20 between the lip 21 of the casing and pressure face 22 of the plastic teeth is kept at a minimum, generally a few ten microns.

The disc springs 17 are designed so that, when assembled, the thrust load they create exceeds the axial load created by the high pressures acting in the direction of arrow 16. They are typically selected so that their load is 150% to 200% of the maximum load encountered by the gaterotor when the compressor operates under the most extreme pressures for which it is designed.

The operation of the system is as follows:

If at some time, generally at start-up, substantial amounts of liquid are ingested by the compressor, the pressure in the groove suddenly raises to much higher values than the maximum designed values; for instance, in air conditioning compressors designed to compress to pressures up to 24,000 or 28,000 hpa, the pressure can reach peak values exceeding 200,000 or 300,000 hPa.

The load on the gaterotor becomes much higher than the thrust load generated by the disc springs which are then compressed, thereby allowing the gaterotor shaft 11 to move axially and to open the gap 20, thereby allowing a release of the pressure in the groove.

Though such displacement of the gaterotor is not instantaneous due to the gaterotor inertia, it is effective to reduce the pressure in the groove at start-up when the grooves are filled with liquid and the motor has trouble rotating the screw. Indeed, at start-up, the torque of the motor reaches around three times the maximum design torque and creates a load on gaterotors which exceeds the spring thrust load, thereby releasing the pressure and allowing the motor to reach its full speed; when the compressor is at full speed, by reducing the length of time where the grooves are exposed to extremely high pressures, it dramatically reduces the stress fatigue inflicted to the compressor components by repeated liquid locks.

As soon as the liquid has disappeared and normal gas compression resumes, the disc spring pushes the shaft 11 against the stop 18 and shrinks the gap 20 to its normal values of a few ten microns.

The disc spring's thickness is generally selected to limit the axial displacement of the gaterotor to values which depend upon the plastic and its dimensions, particularly its thickness; as already explained, the axial motion of the gaterotor results into the groove seeming to become narrower for the teeth and excessive displacement could create permanent damages; but displacements of the magnitude of 0.5 or even 1 mm have been found to be sustained by the plastic teeth without penalties.

As already explained, because of the very short length of time of the liquid lock, the gaterotor teeth do not suffer permanent wear and the compressor performances remain unaffected.

The invention has been shown with a gaterotor rotating around a fixed shaft but it could be applied to other assemblies, for instance when the gaterotor shaft is part of the gaterotor support and rotates with it and the bearings holding the gaterotor shaft are directly mounted in the casing.

Figure 3:
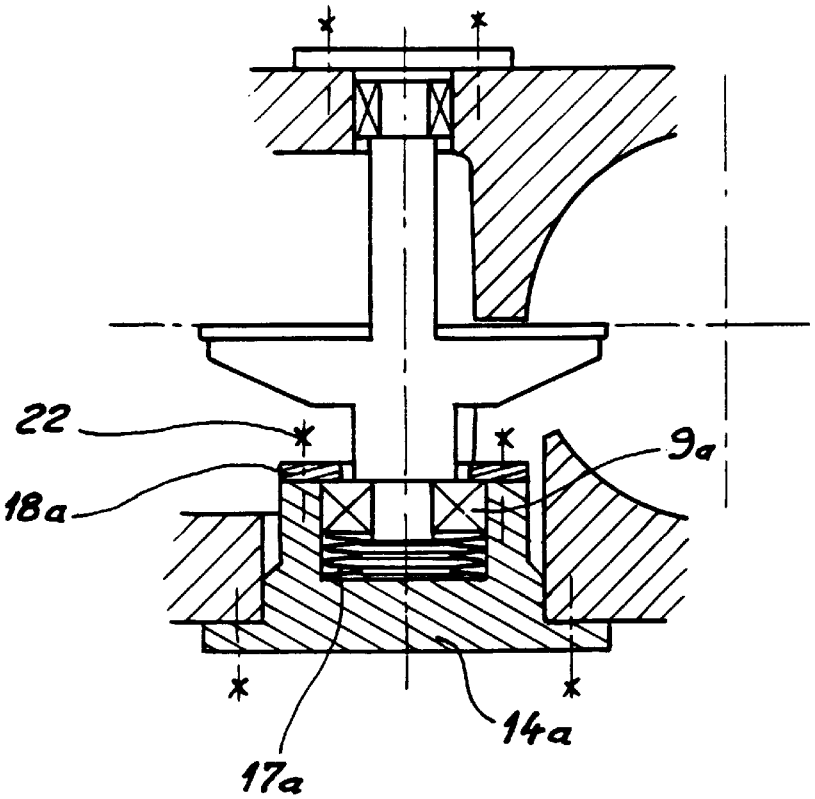
FIG. 3 is a sectional part view, like FIG. 1, of an alternate arrangement of the invention using a gaterotor with rotating shaft.

In such case, the thrust means 17*a* would hold the bearing against the flange 18*a* secured to the holder 14*a* by bolts 22 as shown on FIG. 3.

The invention would not be modified in substance if the springs 17 used to generate the thrust maintaining the gaterotor axis against the stop 18 were replaced by other thrust generating means such as a piston pushed by a gas pressure, for instance the discharge high pressure and the piston having a surface large enough so that its thrust be higher, in any condition but a liquid lock, than the load created on the gaterotor teeth by the gas under compression.

The invention would also apply if the stopping means against which the gaterotor is pressed by the thrust means were located, not in the side of the casing located on the high pressure side of the gaterotor, but at another place.

For instance, the invention applies to the case when the stopping means are located on the low pressure side of the shaft 11.

Such means could be a pin set perpendicularly through the shaft 11 in the area of the bore and of an oblong hole made in the support 14.

Then, in the extreme position, when set by the thrust means, the clearance 20 is at the desired value of a few ten microns. In the other extreme position of the pin in the oblong hole, the clearance 20 reaches the value of 0.5 mm or even 1 mm.

Nevertheless, a construction such as shown in FIG. 1 when the shaft is pushed against stopping means solidly attached to the high pressure side of the casing is better as, in normal operating conditions, the clearance 20 is not affected by casing distortions due to the changes of pressure or temperature which produce relative displacements of the same magnitude or larger than the set clearance 20.

I claim:

1. A compressor for compressing a gas, comprising:

a casing;

a screw rotatably mounted in said casing, said screw having at least one groove;

a gaterotor rotatably mounted on a shaft that is axially movable within said casing, said gaterotor having teeth that mesh with said groove, said teeth having a resilient high pressure side and a low pressure side with a differential pressure therebetween creating a load on said gaterotor when the compressor is operating normally, said high pressure side being in sealing proximity with a part of said casing, said low pressure side of said teeth comprising a rigid support for said resilient high pressure side;

stopping means for stopping axial movement of said shaft beyond a predetermined position; and thrust means for urging said shaft axially toward said stopping means with a force greater than the load on said gaterotor created by the differential pressure when the compressor is operating normally.

2. The compressor of claim 1, wherein said shaft does not rotate.

3. The compressor of claim 1, wherein said stopping means is located in said casing at an axial end of said shaft on a high pressure side of said gaterotor.

4. The compressor of claim 1, wherein said resilient high pressure side of said teeth comprises a plastic sheet.

5. The compressor of claim 1, wherein said thrust means comprises disc springs.

6. The compressor of claim 5, wherein said disc springs are carried in a holder set in a bore in said casing.

7. A liquid lock relief system for relieving a liquid lock in a positive displacement rotary compressor that includes a gaterotor having a high pressure side and a low pressure side with a differential pressure therebetween creating a load on the gaterotor when the compressor is operating normally, the relief system comprising:

an axially movable shaft for rotatably carrying the gaterotor;

a stopper adjacent one axial end of said shaft for stopping axial movement of said shaft; and a spring urging said shaft axially toward said stopper with a force greater than the load on the gaterotor created by the differential pressure when the compressor is operating normally and less than pressure from a liquid lock in the compressor so that said shaft is axially displaced when liquid lock is present to relieve the liquid lock pressure.

* * * * *